US006071184A

United States Patent [19]

Anderson, III

[11] Patent Number: 6,071,184

[45] Date of Patent: Jun. 6, 2000

[54] FLUID DEFLECTING DEVICE FOR USE IN WORK PIECE HOLDER DURING A SEMICONDUCTOR WAFER GRINDING PROCESS

[75] Inventor: David T. Anderson, III, Vancouver, Wash.

[73] Assignee: SEH America, Inc., Vancouver, Wash.

[21] Appl. No.: 09/146,087

[22] Filed: Sep. 2, 1998

[51] Int. Cl.[7] ..... B24B 41/06

[52] U.S. Cl. ..... 451/398; 451/364; 451/451

[58] Field of Search ..... 451/41, 364, 385, 451/398, 415, 451

[56] References Cited

U.S. PATENT DOCUMENTS

| | | | |
|---|---|---|---|
| 3,818,648 | 6/1974 | Evans | 451/451 |
| 4,864,779 | 9/1989 | Ozaki . | |
| 5,005,321 | 4/1991 | Barth et al. | 451/451 X |
| 5,031,325 | 7/1991 | Walter et al. | 451/451 X |
| 5,062,384 | 11/1991 | Foley et al. . | |
| 5,148,652 | 9/1992 | Herzog | 451/451 X |
| 5,159,374 | 10/1992 | Groshong . | |
| 5,163,252 | 11/1992 | Garner et al. | 451/451 |
| 5,185,965 | 2/1993 | Ozaki . | |
| 5,766,451 | 6/1998 | Sparling . | |
| 5,896,640 | 4/1999 | Lanzinski et al. . | |

*Primary Examiner*—Timothy V. Eley
*Attorney, Agent, or Firm*—Kolisch Hartwell Dickinson McCormack & Heuser

[57] ABSTRACT

A fluid deflection device for use in a work piece holder during a semiconductor wafer grinding process is disclosed. The fluid deflection device includes an annular, upstanding splash fence, and an attachment portion associated with the splash fence and configured to attach to the work piece holder, thereby to hold the splash fence in a position to inhibit fluid from flowing between rotatable and non-rotatable parts of the work piece holder.

6 Claims, 3 Drawing Sheets

FLUID DEFLECTING DEVICE FOR USE IN WORK PIECE HOLDER DURING A SEMICONDUCTOR WAFER GRINDING PROCESS

FIELD OF THE INVENTION

The present invention relates to semiconductor wafer edge or notch grinding machines, and more particularly, to a device that inhibits fluid flow between rotating and non-rotating parts of such a grinding machine.

BACKGROUND ART

When producing semiconductor wafers, it is necessary to grind a predetermined profile or bevel on the perimeter of the wafer. Typically, this step is carried out on a machine known as an edge grinder, which includes a rotatable chuck mounted on top of a non-rotatable assembly known as a theta unit. The non-rotatable assembly is called a theta unit because the chuck on the assembly rotates a wafer through an angle, commonly referred to as "theta." The semiconductor wafer is placed on the chuck and, as the chuck is rotated or otherwise displaced, the edge of the wafer is carried past a spinning grinding head to create the desired profile. Known edge grinders are disclosed in U.S. Pat. Nos. 5,185,965 and 4,864,779, both to Ozaki, and the disclosures of both are incorporated herein by reference in their entireties.

Because the perimeter of the wafer is rotated past the grinding head by the chuck, it is critical that the wafer be perfectly centered over the rotation axis of the chuck. If the wafer is off-center, a "grind-out" may occur, where the grinding, head does not contact the entire perimeter of the wafer because of the eccentric position of the wafer. Any grind-out on a wafer snakes the wafer unusable and thus reduces overall production. Once the wafers are off-center, the chuck must be re-aligned—a time-consuming task that causes manufacturing down-time. Semiconductor manufacturers continually search for ways to reduce the down-time due to re-alignment requirements.

During the grinding operation it is important to ensure that the wafer is kept at an even temperature to prevent warping. This is typically accomplished lby spraying the wafer with a coolant fluid, such as water. One problem with spraying the wafer with coolant is that the coolant finds its way underneath the chuck and into the theta unit. Contaminants and small wafer grindings that are carried by the coolant tend to degrade the seals within the theta unit, especially any seal designed to prevent fluid flow between the rotatable and non-rotatable portions of the edge grinder. When such a seal is degraded, the coolant may find its way into internal bearings of the theta unit, wash out the grease in which the bearings are packed, thereby destroying the internal bearings and causing the chuck to rotate off-center. Furthermore, fluid breaching the seals may also find its way into a motor positioned below the theta unit and damage a sensitive optical encoder that is essential to precise electronic control of the motor during grinding operations. At a minimum, fluid intrusion through the seals will result in a compromise in the precision of the theta unit. Additionally, intrusion of fluid across the theta unit will result in damage to the motor assembly.

Efforts to reduce fluid intrusion underneath the chuck have included inserting a drain collar or other draining device within the grinding machine. While such measures may reduce the amount of fluid intrusion, even a small amount of contaminant-laden fluid sitting on the seals degrade,; the seals over time.

SUMMARY OF THE INVENTION

The present invention overcomes these problems by providing a fluid deflection device for use in a work piece holder during a semiconductor wafer grinding process. The device includes an annular, upstanding splash fence, and an attachment portion associated with the splash fence and configured to attach to the work piece holder, thereby to hold the splash fence in a position to inhibit fluid from flowing between rotatable and non-rotatable parts of the work piece holder.

DETAILED DESCRIPTION AND BEST MODE FOR CARRYING OUT THE INVENTION

Figure 1:
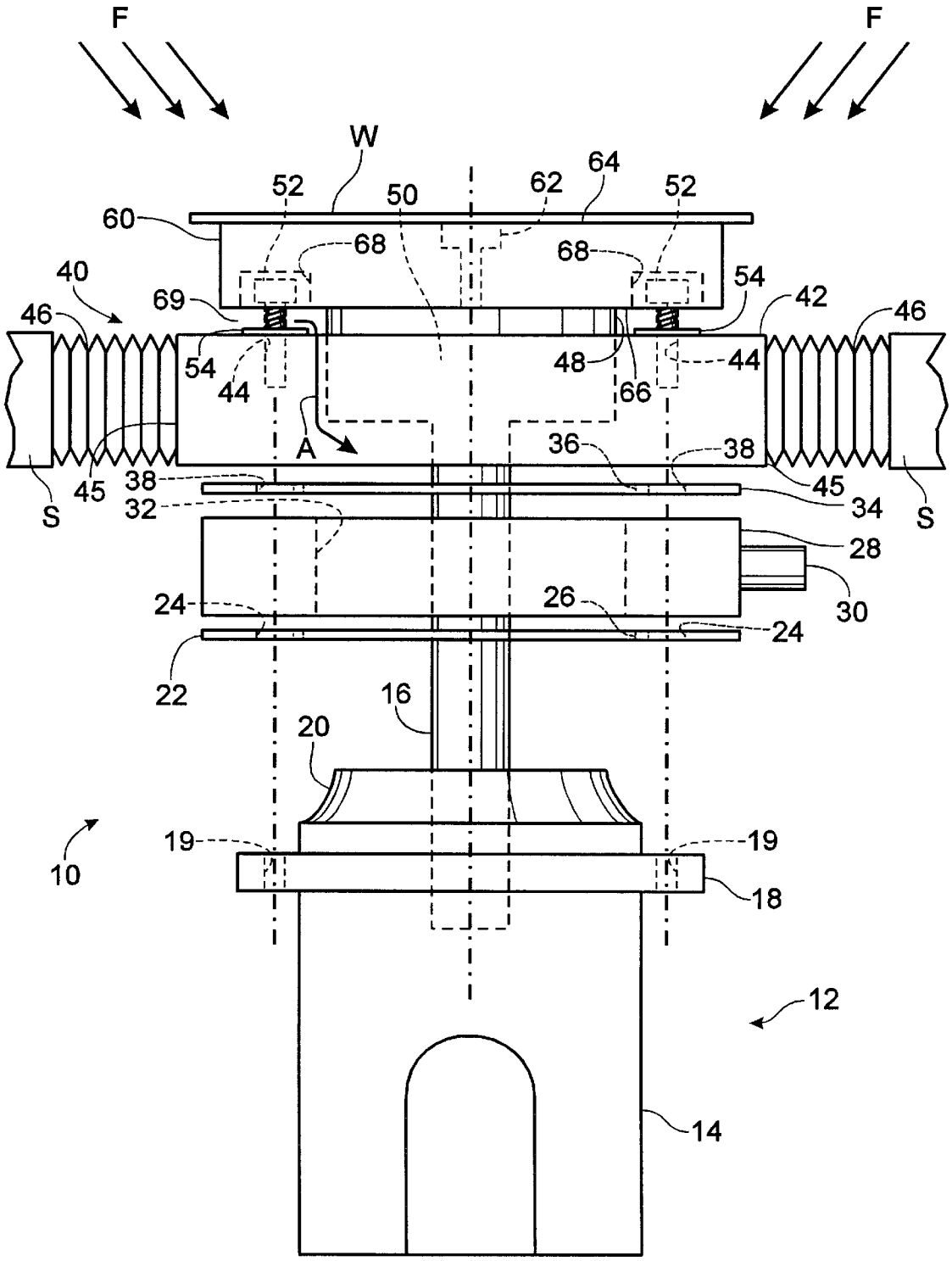
FIG. 1 is a side elevational view showing a work piece holder in exploded form, for use in a wafer grinding machine.

FIG. 1 shows a theta unit or work piece holder 10, used in semiconductor wafer edge-grinding and/or notch-grinding machines, mounted within a supporting framework S. Work piece holder holds and rotates a semiconductor wafer W while a grinding head (not shown) grinds the wafer. The grinding head can include a rotating element, embedded with abrasives, that is moved into contact with wafer W during the grinding process. To aid in correctly positioning the wafer during grinding, the work piece holder may also be configured to move horizontally. Work piece holder 10 includes a non-rotatable part 12 that has a base 14. The base supports work piece holder 10 and has a hollow interior, through which a rotatable shaft 16 may pass. A motor (not shown) is disposed below base 14 and rotates shaft 16 as required. Base 14 houses a set of bearings (not shown) that holds shaft 16 and permit relative rotation between the base and the shaft. At the top of base 14 is a flanged area 18, through which are disposed a plurality of bolt holes 19, and upon which a first seal 20 is placed. First seal 20 is designed to prevent dust and moisture from entering the interior of the base. Seal 20 has an interior portion (not shown) that contacts rotating shaft 16.

A second, or bottom seal 22, is placed on flanged area 18 and includes a; plurality of bolt holes 24, the number of which corresponds to the number of bolt holes 19 in flanged area 18. Bottom seal 22 has an opening 26 that is at least large enough to permit shaft 16 to pass therethrough, resulting in bottom seal 22 resembling a flat ring. A drain collar 28 is placed atop bottom seal 22 and includes a drain hose fitting 30. Fluid that is accumulated within the drain collar may be taken out of the drain collar via a drain hose (not shown) attached to fitting 30. Drain collar 28 includes an interior hole 32 having a diameter at least large enough for shaft 16 to pass therethrough. A third, or top seal 34 is placed atop drain collar 28 and has an opening 36 and a plurality of bolt holes 38 substantially identical in arrangement and size as bolt holes 24 and opening 26 of bottom seal 22.

A bellows cover 40 is placed on top seil 34. Bellows cover 40 provides some protection to the work piece holder from cooling fluid F and dust. The bellows cover includes a top section 42 that has a plurality of bolt holes 44, and a plurality of side sections 45 designed to extend over and around the portion of work piece holder 10 that has been heretofore described. Attached to the sides of bellows cover 40 are accordion-like bellows 46 that expand and retract to protect work piece holder 10 from fluid F as the work piece holder moves horizontally during a grinding process. Bellows cover 40 and bellows 46 are attached to supporting framework S. Top section 42 of bellows cover 40 includes a central bore 48 that has a diameter just large enough to allow an upper portion or table 50 of shaft 16 to extend slightly therethrough without contacting the upper portion. fable 50 typically has a diameter larger than the remainder of shaft 16.

A plurality of bolts 52 extend through bolt holes 44, 38, 24 and 19, thereby attaching bellows cover 40, drain collar 28 and seals 22 and 34 to base 14. Seal washers 54 are placed between the heads of bolts 52 and top section 42 to prevent water from passing through bolt holes 44, 38, 24 and 19.

Figure 2:
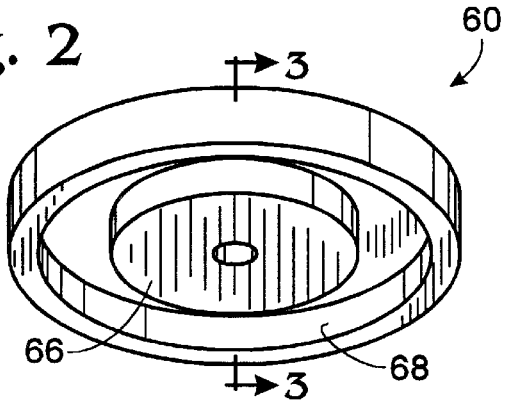
FIG. 2 is a perspective view of a chuck used in the work piece holder of FIG. 1.
Figure 3:
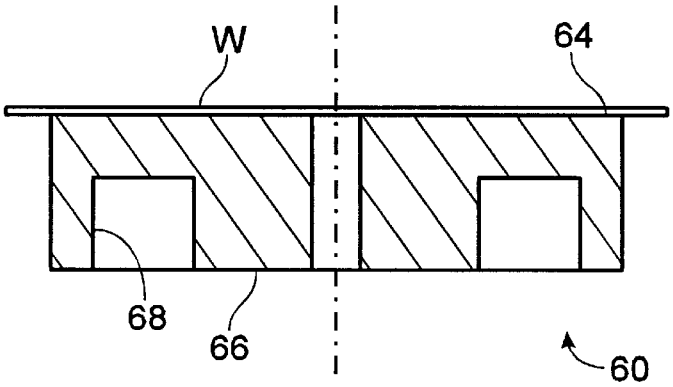
FIG. 3 is a sectional view taken along 3—3 in FIG. 2.

As shown in FIGS. 1–3, a circular chuck 60 is attached to table 50 via a central bolt 62. Chuck 60 provides a surface 64 upon which wafer W is placed during the grinding operation. Chuck 60 and shaft 16 together form a rotatable part of the work piece holder and are powered by the electric motor-driven shaft 16. To provide an adequately large surface 64, chuck 60 typically has a diameter that is greater than the diameter of table 50. The bottom side 66 of chuck 60 includes an annular depression 68 that provides clearance for bolts 52 as the chuck is rotated with respect to bellows cover 40. Annular depression 68 allows the chuck to be placed as close as possible to bellows cover 40 without contacting either the bellows cover or bolts 52. However, fluid F sprayed to cool the wafer may enter the gap 69 between chuck 60 and bellows cover 40, as shown by arrow A in FIG. 1. The fluid, which typically is water, then makes its way between table 50 and central bore 48 of bellows cover 40 and seeps down into work piece holder 10. Although most fluid accumulates within drain collar 28 and is drained out of drain hose connection 30, some fluid is not collected by the drain collar and migrates to rest on first seal 20. The fluid resting thereon eventually degrades the seal and destroys the motor (not shown) and the bearings (not shown) that hold shaft 16.

Figure 4:
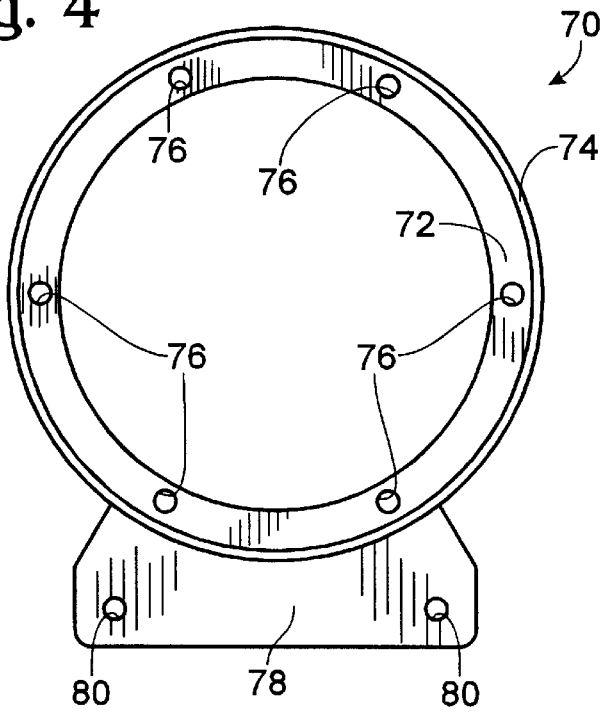
FIG. 4 is a top plan view of a fluid deflecting device according to the present invention.
Figure 5:
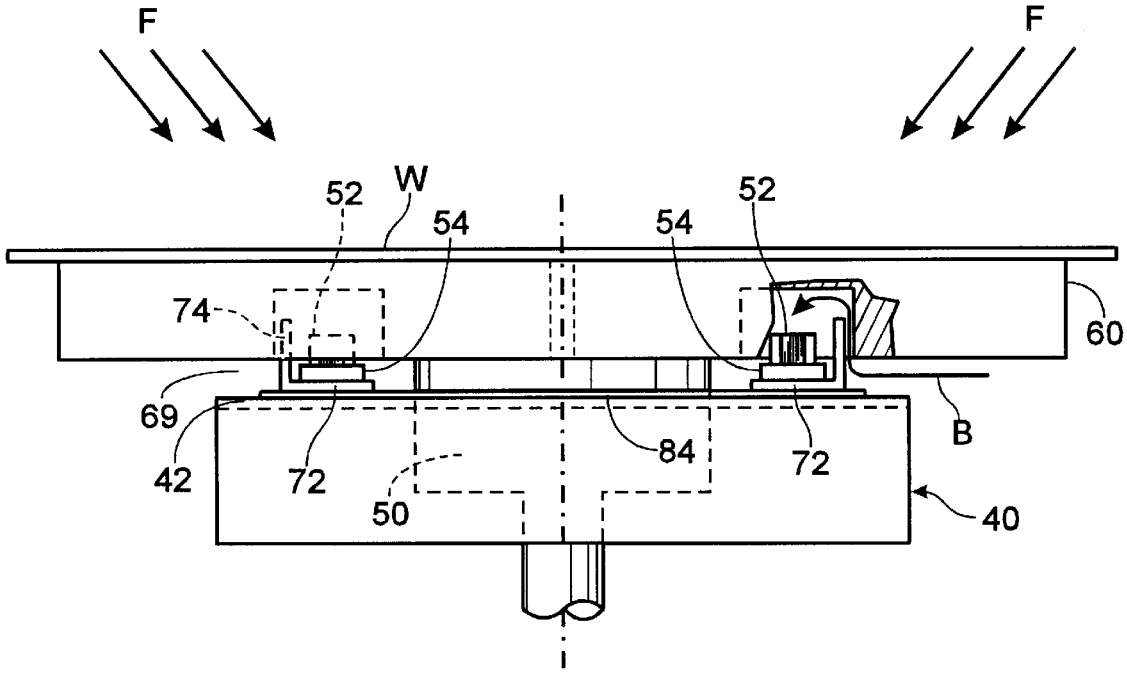
FIG. 5 is a detail view of a portion of the work piece holder shown in FIG. 1, including a fluid deflecting device according to the present invention.
Figure 6:
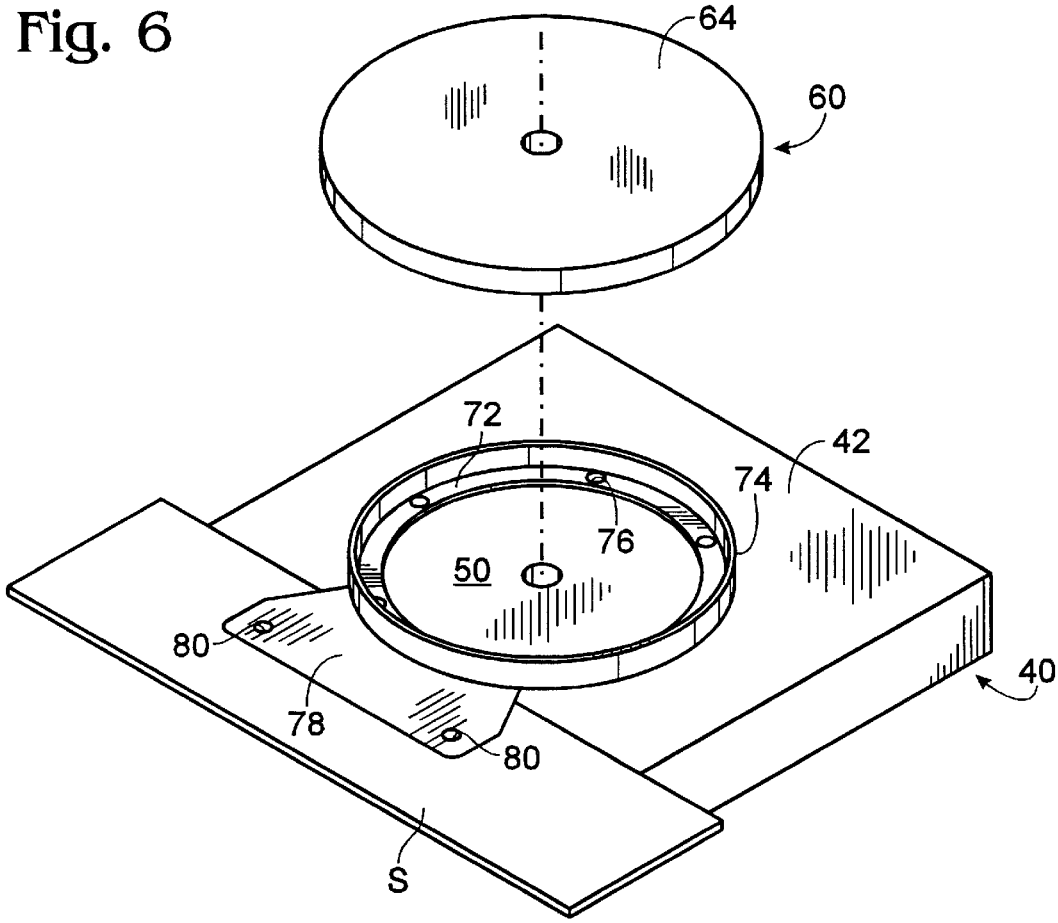
FIG. 6 is a perspective view of the present invention installed on a work piece holder.

To prevent this fluid intrusion, a fluid deflection device 70 is provided that inhibits water flow between the non-rotatable and the rotatable parts of the work piece holder. As shown in FIGS. 4–6, fluid deflection device 70 has first and second annular portions 72, 74 formed perpendicular to each other. The device may be made from stainless steel, plastic, or other materials that are acceptable for use in the wafer-grinding environment. First annular portion 72 has a plurality of bolt holes 76 designed to correspond in number, size and position to bolt holes 44 on top section 42 of bellows cover 40. A lateral extension 78 projects from first annular portion 72 and has a plurality of bolt holes 80 that enable device 70 to be bolted or otherwise attached to a portion of supporting framework S, shown partially in FIG. 6. Second annular portion 74 extends perpendicular to first annular portion 72 and is designed to extend upwardly into annular depression 68 of chuck 60.

Fluid deflection device 70 is designed to be placed on top section 42 of bellows cover 40 and below chuck 60. Fluid deflection device is installed by removing bolts 52 and placing first annular portion 72 on top section 42 of bellows cover 40 so that bolt holes 80 align with bolt holes 44. A thin seal 84, similar in construction to top and bottom seals 22, 34 may be placed between first annular portion 72 and top section 42. Bolts 52 are inserted through optional seal washers 54 and into bolt holes 76, 44, and the bolts are then tiglitened.

Once fluid deflection device 70 is installed in work piece holder 10, fluid F can enter the holder only by traveling above second annular portion 74, as shown by arrow B in FIG. 5. Since it is difficult for the fluid to travel this route, the amount of fluid entering work piece holder 10 is greatly reduced. This lengthens the life of the work piece holder because very little fluid will ever enter the holder to degrade the seals. Fluid deflection device 70 thus acts as a splash fence that inhibits fluid from entering the work piece holder.

One advantage of the fluid-deflecting device of the present invention is that it may be installed in a work piece holder Without having to modify the work piece holder. Bolt holes 76, 80 align with other bolt holes already existing in the holder. Another advantage is that use of the device does not interfere with the operation of the work piece holder. Still another advantage is that because the amount of fluid intrusion is greatly reduced, repair, realignment and re-manufacturing time and costs for the work piece holder are correspondingly reduced. Yet another advantage is that the device is inexpensive to manufacture and install.

INDUSTRIAL APPLICABILITY

The invention is applicable in the semiconductor processing industry, and is specifically applicable to wafer grinding processes. While the invention has been disclosed in its preferred form, it is to be understood that the specific embodiments disclosed and illustrated are not to be considered in a limiting sense, as numerous variations are possible, and no single feature, function or property of the disclosed embodiments is essential. The invention is to be defined only by the scope of the claims.

I claim:

1. A work piece holder to hold a semiconductor wafer during grinding of the wafer, the work piece holder comprising:

a rotatable chuck configured to support a semiconductor wafer during grinding, the chuck having a bottom and an annular depression in the bottom;

a non-rotatable portion adjacent the chuck; and a fluid deflection device mounted between the chuck and the non-rotatable portion, where the fluid deflection device includes an annular, upstanding wall configured to extend into the annular depression in the bottom of the chuck, and where the fluid deflection device inhibits fluid from traveling under the chuck.

2. The work piece holder of claim 1 further comprising a seal between the fluid deflection device and the non-rotatable portion.

3. The work piece holder of claim 1 wherein the fluid deflection device is mounted between the chuck and the non-rotatable portion by bolts extending through holes in the fluid deflection device.

4. The work piece holder of claim 1 wherein the fluid deflection device further includes a lateral extension to mount to the non-rotatable portion.

5. The work piece holder of claim 1 wherein the fluid deflection device includes an annular flange extending substantially perpendicularly to the annular, upstanding wall, and wherein the annular flange includes bolt holes through which the fluid deflection device may be mounted to the non-rotatable portion.

6. A work piece holder to hold a semiconductor wafer during grinding of the wafer, the holder comprising:

a rotatable chuck configured to support a semiconductor wafer during grinding, the chuck having a bottom and an annular depression in the bottom;

a non-rotatable portion adjacent the chuck; and fluid deflection means mounted between the chuck and the non-rotatable portion for inhibiting fluid from travelling under the chuck.

* * * * *